United States Patent [19]

Mitsumoto et al.

[11] Patent Number: 4,700,740

[45] Date of Patent: Oct. 20, 1987

[54] DISCHARGE VALVE

[75] Inventors: Takashi Mitsumoto, Kassel; Dankwart Eiermann, Weissensberg; Roland Nuber, Lindau, all of Fed. Rep. of Germany

[73] Assignees: Aisin Seiki Kabushiki Kaisha, Kariya, Japan; Firma Wankel GmbH, Lindau, Fed. Rep. of Germany

[21] Appl. No.: 855,708

[22] Filed: Apr. 25, 1986

[30] Foreign Application Priority Data

Apr. 26, 1985 [DE] Fed. Rep. of Germany ..... 3515239

[51] Int. Cl.[4] ..... F16K 15/14

[52] U.S. Cl. ..... 137/512.15; 137/853

[58] Field of Search ..... 137/512.15, 853, 860

[56] References Cited

U.S. PATENT DOCUMENTS

| | | | |
|---|---|---|---|
| 209,525 | 10/1878 | Tonkin | 137/853 X |
| 771,327 | 10/1904 | Schmidt | 137/512.15 |
| 4,149,834 | 4/1979 | Eiermann | 137/512.15 X |
| 4,241,758 | 12/1980 | Eiermann | 137/512.15 |
| 4,305,424 | 12/1981 | Wankel | 137/512.15 |

FOREIGN PATENT DOCUMENTS

| | | |
|---|---|---|
| 2700522 | 7/1978 | Fed. Rep. of Germany . |
| 2743038 | 3/1979 | Fed. Rep. of Germany . |

*Primary Examiner*—Robert G. Nilson

*Attorney, Agent, or Firm*—Oblon, Fisher, Spivak, McClelland & Maier

[57] ABSTRACT

A discharge valve which includes a housing provided with a plurality of discharge holes, a plurality of seat portions formed on an inner circumferential face of the housing and a portion surrounding the discharge holes, a valve member disposed within the housing and provided with a plurality of valve portions, a valve support member disposed within the housing for supporting the valve member and a projecting member provided between the discharge holes on the inner circumferential face of the housing.

6 Claims, 4 Drawing Figures

DISCHARGE VALVE

BACKGROUND OF THE INVENTION

1. Field of the Invention

The present invention relates to a discharge valve, and more particularly to a discharge valve for compressors.

2. Description of the Prior Art

In a conventional discharge valve 10 in FIG. 1, a housing 11, a plurality of discharge holes 12 provided in the housing 11, a plurality of seat portions 13 formed on an inner circumferential face of the housing 11 and at a portion surrounding the discharge holes 12, and a valve member 14 having a plurality of valve portions 15 are provided. The discharge gas which passes through the discharge hole 12 of the housing 11 in FIG. 1 is interrupted between the discharge holes 12 of the housing 11, so that the pressure drop is increased between the valve portions 15 of the valve member 14. As a result, an unnecessary pressure value for the discharge is required, and this causes a decrease in compressor efficiency and an increase in input performance.

SUMMARY OF THE INVENTION

An object of the present invention is to provide an improved discharge valve which obviates the aforementioned drawbacks of the described conventional discharge valve.

A further object of the present invention is to provide an improved discharge valve which has a high efficiency.

A still further object of the present invention is to provide an improved discharge valve which can achieve improved functioning without increasing the number of parts required.

To achieve the objects and in accordance with the purpose of the invention, a discharge valve according to the present invention includes a housing provided with a plurality of discharge holes, a plurality of seat portions formed on an inner circumferential face of the housing and a portion surrounding the discharge holes, a valve member disposed within the housing and provided with a plurality of valve portions, a valve support member disposed within the housing for supporting the valve member, and projecting means provided between the discharge holes and said inner circumferential face of the housing. Accordingly, the discharge gas is rectified by projecting means and the discharge gas is not interrupted between the valve portions of the valve member and the pressure drop is not increased therebetween. As a result, the gas pressure within the chambers of the compressor is not unnecessarily increased in comparison with a certain discharge pressure. This allows for high efficiency of the compressor and a corresondingly low input performance is required upon discharging.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENT

Figure 2:
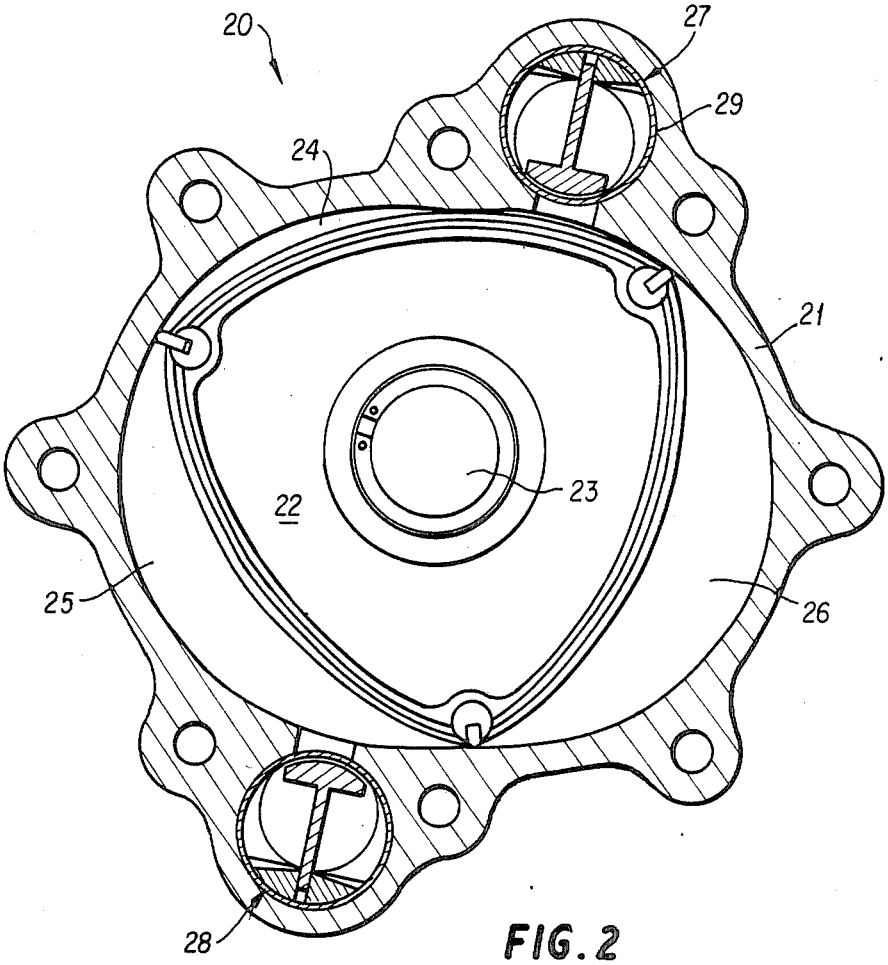
FIG. 2 is a cross sectional view which shows a preferred embodiment of a rotary piston compressor according to the present invention.

Referring now to FIG. 2, reference numeral 20 denotes a rotary piston compressor which includes a housing 21, a rotor 22 rotatably disposed within the housing 21 about a shaft 23, three chambers 24, 25, 26 and two discharge valves 27, 28.

Figure 1:
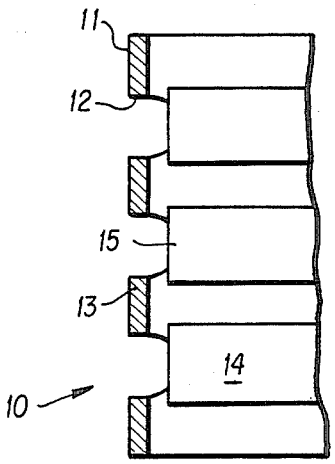
FIG. 1 PRIOR ART
FIG. 1 is a sectional view which shows a conventional discharge valve.
Figure 4:
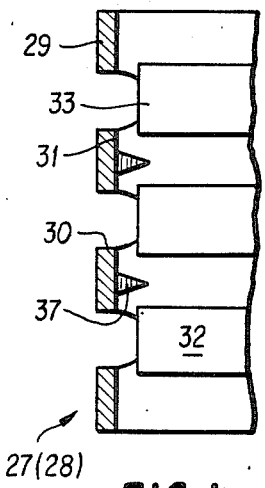
FIG. 4 is a sectional view which shows the discharge valve of the present invention.
Figure 3:
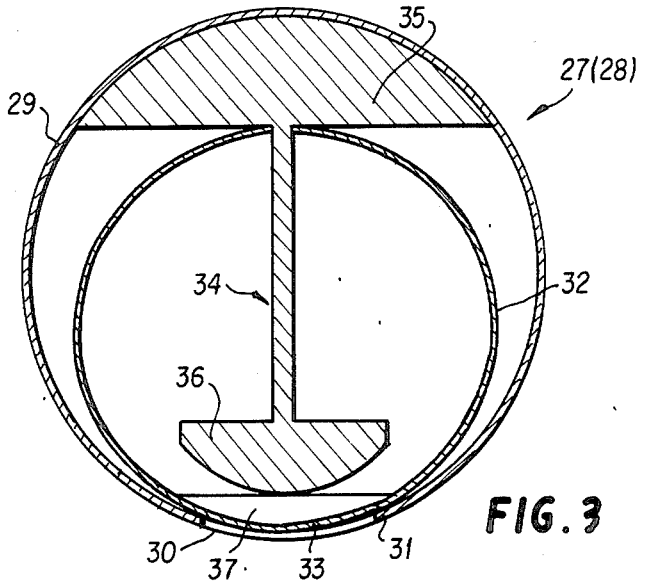
FIG. 3 is a view similar to FIG. 2 which, however, shows a discharge valve according to the present invention.

In FIGS. 3, 4, the discharge valve 27 which has the same construction as discharge valve 28, comprises a housing 29 having a cylindrical shape, a plurality of discharge holes 30 formed on the housing 29, a plurality of seat portions 31 mounted on an inner circumferential face of the housing 29 and a portion surrounding the discharge holes 30, a valve member 32 having a cylindrical shape disposed within the housing 29 and provided with a plurality of valve portions 33, and a valve support member 34 disposed with the housing 29 and provided with a valve support portion 35 and a projecting portion 36. The valve member 32 is supported by the valve support portion 35 of the valve support member 34. The projecting portion 36 of the valve supporting member 34 is contacted with an inner circumferential face of the valve portion 33 of the valve member 32 upon discharging.

As clearly shown in FIG. 4, a plurality of projections 37 are provided between each of discharge holes 30 and the inner circumferential face of the housing 29. It may be possible for the projection 37 to be integrally provided with the housing 29 or to be separate therefrom. The circumferential length of the projection 37 is nearly equal to the circumferential length of the discharge hole 30 of the housing 29 or is longer. The height of the projection 37 in the radial direction is nearly equal to the stroke of the valve portion 33 of the valve member 32. A free end of the projection 37 is preferably narrow in order to maintain rectification of the discharge gas and the wide discharge area. Various modifications of the shape of the projection 37 so as to satisfy the above-mentioned functions are possible, for example, such may be of a triangular shape, an arch shape, etc. in cross section.

Operation according to the present invention is as follows: When the rotor 22 is rotated about the shaft 23 in accordance with the drive of a motor or an engine (not shown) in FIG. 2, the volume of chambers 24, 25, 26 formed by the housing 24 and the rotor 22 is changed by turning. The gas pressure, for example, within the chamber 25 is increased upon the decrease of the volume thereof and then reaches certain discharge pressure. At this time, the valve portion 33 of the valve member 32 is released from the seat portion 31 of the housing 29. Accordingly, the gas is discharged to a high pressure chamber (not shown) through the discharge holes 30 of the housing 29 and between the valve portions 33 of the valve member 32. However, at this time the discharge gas is rectified by the projection 37, so that the discharge gas is not interrupted between the valve portions 33 of the valve member 32 and no increase in pressure drop therebetween occurs. As a result, the gas pressure within the chamber 25 of the rotary piston compressor 20 is not unnecessarily increased in comparison with a certain discharge pressure. This allows for high efficiency of the rotary piston compressor 20 and only a low input performance is required upon discharging.

By the foregoing, there has been disclosed a preferred form of a discharge valve for compressors constructed in accordance with the present invention. It will be appreciated that various additions, substitutions, modifications and omissions may be made thereto without departing from the spirit of the invention.

What is claimed as new and desired to be secured by Letters Patent of the United States is:

1. A discharge valve, comprising:

a housing provided with a plurality of discharge holes;

a plurality of seat portions formed on an inner circumferential face of said housing and a portion surrounding said discharge holes;

a valve member disposed within said housing and provided with a plurality of valve portions;

a valve support member disposed within said housing for supporting said valve member; and projecting means provided between said discharge holes and said inner circumferential face of said housing and projected between said valve portions, said projecting means having a relatively narrow, tapered free end portion.

2. A discharge valve as set forth in claim 1 wherein said projecting means is integrally provided with said housing.

3. A discharge valve as set forth in claim 1 wherein a circumferential length of said projecting means is at least nearly equal to a circumferential length of said discharge hole.

4. A discharge valve as set forth in claim 1 wherein a height dimension of said projecting means in a radial direction is nearly equal to a stroke of each of said valve portions of said valve member.

5. A discharge valve as set forth in claim 1, wherein said projecting means is connected to said housing.

6. A discharge valve as set forth in claim 1, wherein said valve support member includes an arcuate shaped valve support portion located at a first end thereof and a second projecting portion located at a second end thereof adjacent said projecting means.

* * * * *

UNITED STATES PATENT AND TRADEMARK OFFICE

CERTIFICATE OF CORRECTION

PATENT NO. : 4,700,740

DATED : 10/20/87

INVENTOR(S) : Takashi MITSUMOTO et al.

It is certified that error appears in the above-identified patent and that said Letters Patent is hereby corrected as shown below:

Column 1, line 57, change "corresondingly" to --correspondingly--; and Column 2, line 26, change "with" to --within--.

Signed and Sealed this

Third Day of May, 1988

*Attest:*

*Attesting Officer*

DONALD J. QUIGG

*Commissioner of Patents and Trademarks*